United States Patent [19]

Lenk et al.

[11] 3,964,657

[45] June 22, 1976

[54] YARN TRANSPORTING APPARATUS

[75] Inventors: Erich Lenk; Karl Bauer; Herbert Turk, all of Remscheid, Germany

[73] Assignee: Barmag Barmer Maschinenfabrik Aktiengesellschaft, Wuppertal, Germany

[22] Filed: July 3, 1974

[21] Appl. No.: 485,614

[30] Foreign Application Priority Data

July 4, 1973 Germany ..... 2365328
May 9, 1974 Germany ..... 2422563

[52] U.S. Cl. ..... 226/177; 226/187
[51] Int. Cl.² ..... B65H 17/22
[58] Field of Search ..... 226/181, 186, 187, 196, 226/176, 177

[56] References Cited

UNITED STATES PATENTS

| | | | |
|---|---|---|---|
| 2,915,170 | 12/1959 | Slayter | 226/186 X |
| 3,372,446 | 3/1968 | Shichman | 28/1.8 |
| 3,462,811 | 8/1969 | Burgess | 28/1.8 X |
| 3,636,600 | 1/1972 | Mertens | 28/1.8 |
| 3,646,646 | 3/1972 | Koizumi | 28/1.8 X |

*Primary Examiner*—Richard A. Schacher
*Attorney, Agent, or Firm*—Johnston, Keil, Thompson & Shurtleff

[57] ABSTRACT

High speed yarn transporting apparatus which requires at least one and preferably two transporting rolls with cylindrical yarn contacting surfaces containing shallow grooves or flutes which preferably extend axially of each roll. When constructed as a pair of nip rolls, the apparatus advantageously includes a jet operated guide member on the discharge side of the nip with means to inject air into a thread guide channel extending in the yarn transporting direction. A number of preferred embodiments of the rolls and a jet operated guide member are disclosed for smooth and positive transport of a yarn at speeds of 3,000 meters per minute or more.

6 Claims, 12 Drawing Figures

YARN TRANSPORTING APPARATUS

In today's manufacture of synthetic yarns, for example polyamides (nylon 6 or nylon 6,6) and polyesters (polyethylene terephthalate), the spinning or spin-draw process as a result of a highly developed technology permits yarn production at a rate of more than 3000 meters per minute. This makes it possible to achieve favorable textile characteristics of the filaments or threads to be used for production of yarns and still to further simplify the manufacturing process with a considerable increase of productivity of the spinning and subsequent drawing or stretching stages.

Special care must be taken, however, to prevent a breaking of the untwisted yarns whose usual sizes are on the order of magnitude of several 100,000 dtex and also to prevent other forms of damage, e.g. the forming of knots, entanglements or so-called "winders" on rotating transport means such as rolls, godets or the like. In particular, the structure of the yarn or filamentary tow must be maintained, i.e., a yarn bundle which consists of substantially parallel, even and uniform continuous filaments.

In the following description and claims, the term "yarn" is used to define any bundle or strand of threads or filaments, for example a continuous thread or yarn, a spun yarn, etc. In general, such yarns are composed of synthetic, thermoplastic fiber-forming polymers such as linear polyamides, polyester, polyolefins, polyacrylonitrile and the like.

With respect to the problem of the breaking of yarn, it should be noted that this may occur when a large number of individual filaments of the yarn change their running direction but it may also occur when only a few individual filaments change their direction, thus disrupting the structure of the yarn partly or completely after a certain time. The specified high yarn transporting speeds of yarns result in any case to such damaging speeds that the term "bursting" is generally justified in place of "breaking." In other words, even minor breakage of just a few filaments of a heavy yarn can quickly lead to pronounced damage and sudden bursting under high speed operation.

One known solution to the problem of preventing "winders," i.e., overlapping or entangled coils of the yarn windings, is to provide a godet with alternating matted and polished axial strips around the circumferential surface; see for example German Patents (DT-OS) No. 19 25 210 and No. 20 06 235. Through this technique, the godet has continuous sections around its circumference which prevent winders but, on the other hand, do not provide effective friction. Thus, one part of the winding angle between the yarn and the godet is not utilized for acquiring the necessary frictional forces.

Yarn transporting devices are also known with two meshing gear wheels (British Pat. No. 950,429) wherein the crown lines of the two gears overlap each other. This arrangement is not suitable for the gentle transport of a yarn of more than 100,000 dtex at high speeds. These intermeshed gear wheels also do not prevent winders because the yarn or thread in its oscillating discharge movement, first being pressed against one gear wheel and then against the other, tends to cause winder formation rather than preventing it.

From U.S. Pat. No. 2,741,009, a set of rotary pulling rolls are known as being especially useful in handling freshly spun glass fibers transported with tensive forces in order to attenuate molten glass streams into glass filaments or fibers. The surface of these pulling rolls has a series of inwardly directed inclined slits so that the surface is separated into individual inclined segments. When stationary, a small gap exists between the two rolls. When operated at circumferential speeds of more than 10,000 ft./min., the individual segments flare outwardly so that the two rolls come in direct contact with each other and tightly grip the strand of glass fibers therebetween. The purpose of this device is not only to pull or draw the strand but also to produce a whip-like effect so that the strand flutters or flaps back and forth in generally horizontal direction. Such a device likewise is not suitable for preventing winders.

Therefore, it is a primary object of the invention to prevent the formation of winders while providing a high speed yarn transporting roll which effectively utilizes the entire winding angle of contact between yarn and roll for the production of frictional forces although essential segments or portions of the transporting roll circumference are not susceptible to winders. Another object of the invention is the utilization of a pair of these transpoting rolls as nip rolls for conveying the yarn therebetween.

Such objects of the invention are achieved, at least in part, by providing in combination with high speed yarn transporting apparatus one and preferably two cooperating transporting rollers which may be arranged on rotatable axes in the yarn path so as to be at least partly encircled by the yarn, each roller containing a plurality of grooves distributed over its cylindrical yarn contacting surface, preferably in the form of shallow channels or notches parallel to the roller axis of rotation.

An especially advantageous embodiment of the invention resides in the arrangement of two such yarn transporting rollers as nip rollers, i.e., side by side on parallel axes of rotation, with conventional means to adjust the axial interval of the rollers so that they exert a clamping or gripping effect on the yarn running therebetween and preferably with conventional drive means such as a variable speed motor to drive the nip rolls at the same speed of rotation. The operation of these nip rolls is further enhanced according to the invention by adding or connecting thereto in the yarn transporting direction, preferably within the flared "bight" or exit angle formed by the two cylindrical yarn contacting surfaces of the transporting rolls at the discharge side of the nip, a jet operated yarn guide device operating on the air injection principle.

The advantage of this preferred nip roll construction is based in part upon the continuous airstream which is led through the clamping gap or nip opening, thus preventing the yarn proceeding from the two rolls from encountering either an air pocket or a turbulent air stream. The grooves or flutes of the rolls further prevent the yarn from becoming unexpectedly caught in the airsteam passing along the surface of the rolls. On the other hand, the grooves or flutes make certain that the transporting action of the nip rolls is not unfavorably influenced by the gap separating them, not even at the highest transporting speeds. It is immaterial whether the grooves of the two rolls always face each other and there is not intermeshing of cogs and grooves. Therefore, the gap separation or nip opening of the rolls may be varied. At the same time, the relative rotations between both wheels within the range of the output capacity and operating or drive tolerances remain unaffected. Only in recognizing this essential independence of the relative rotational position of each nip roller and the ability to provide a variable gap or nip opening, e.g. using only a light resilient pressure and/or maintaining a minimum nip opening, did it become possible to construct a practical high speed yarn transporting device according to the invention.

The high speed yarn transporting apparatus according to the invention with its advantages and improved features are described in detail with the aid of the accompanying drawings wherein:

FIG. 1 ilustrates one simple embodiment of the invention using two sequential transporting rollers containing axial grooves;

FIG. 1*a* is a slightly enlarged cut-away section of one roller according to FIG. 1 modified to illustrate a preferred rounding of the truncated cog between two grooves;

FIG. 2 illustrates another embodiment of a transporting roller containing a large number of grooves and cogs of about equal size;

FIG. 2*a* is an enlarged cut-away section of the roller shown in FIG. 2;

Figure 1:
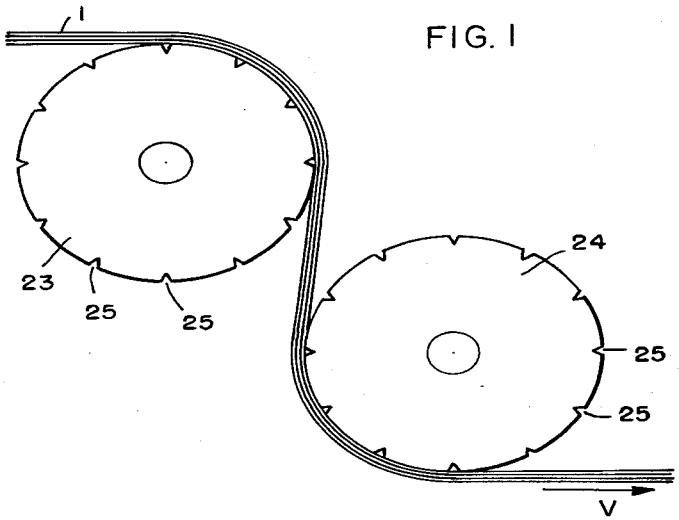

Referring first to FIG. 1, there is illustrated a dual conveyor roll system wherein the two rollers 23 and 24 are constructed in the same manner with a number of grooves 25 distributed evenly at relatively large intervals over the yarn contacting circumferential surfaces. In one specific embodiment, the rollers 23 and 24 each have a diameter of 210 mm. and contain 40 grooves at equal intervals over the circumference. Although a spun yarn or filamentary thread 1 after roller 23 and also after roller 24 exhibits only a slight tension, this construction of the rollers completely prevented lappings or so-called "winders" on the roller surfaces. By comparison, cylindrical rollers with conventional surfaces have a strong tendency to form "winders" under the same test conditions, i.e., the same yarn 1 being transported at the same velocity V as indicated by the arrow.

Figure 2:
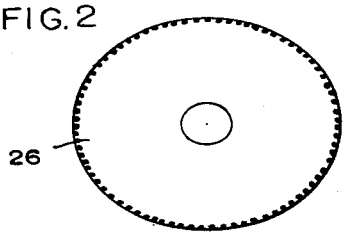
Figure 2A:
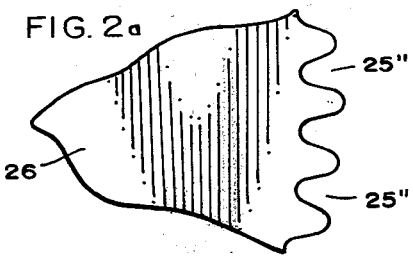

In FIG. 2, only a single roller is illustrated as having a large number of alternate grooves and cogs of about equal size as indicated in FIG. 2*a*. This embodiment can replace rollers 23 and 24 in FIG. 1 or else can be used as the rollers 26 and 27 in FIG. 3. One specific model of a roller 26 has been used with a crown line diameter of 210 mm. and with a module or pitch diameter of 0.5 mm. Such a gear is in the form of a spur gear or so-called "stub-tooth gear" having rounded grooves and cogs (FIG. 2*a*). The whole depth of the gear in the noted model measured 0.3 mm., i.e., the total depth of the groove or the total height of the tooth.

Figure 1A:
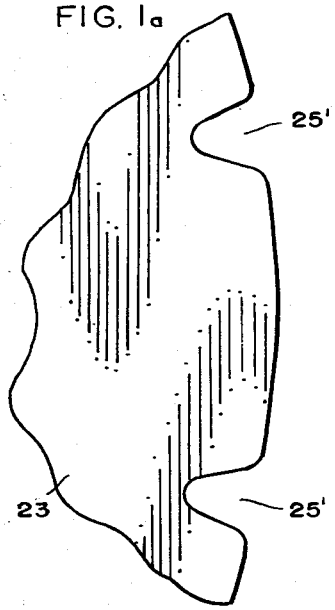

The peferred arrangement of the grooves 25′ or 25″ as shown in FIGS. 1 and 2 or especially in the fragments shown in FIGS. 1*a* and 2*a* is to make them parallel to the roller axis of rotation and to provide them with relatively shallow grooves and rounded edges. It has proven to be advantageous, if only to reduce the amount of noise, to construct the rollers in the form of gears or cog wheels to provide the necessary grooves or flutes. Short, truncated and rounded cogs or teeth, as in stub-tooth gears, have been found to be especially useful in this respect because of their lower noise level.

The term "stub-tooth gears" refers to those spur gears in which the radial teeth or cogs have an addendum which is shorter in length than the dedendum (corresponding to the upper face and the lower flank of the gear tooth, respectively). For purposes of the present invention, this means that the portion of the gear tooth extending outside of the pitch circle is relatively small in comparison to the whole depth of the groove between adjacent teeth.

The teeth or cog surfaces which come in contact with the running yarn can be given a matt finish; however, it is considered to be advantageous to provide a smooth or polished finish on these surfaces because this results in a higher coefficient of friction for this yarn as compared to a matt finish. A surface roughness range on the order of 0.5 to 32 microinches, e.g. a superfinish or polish, is especially preferred. The crest or lateral shoulders of the teeth or cogs are preferably rounded to avoid damage to the yarn or the individual filaments. Such rounding also provides better frictional engagement of the yarn due to the angle at which the yarn is deflected along these lateral shoulders.

In more general terms, it is advantageous to provide yarn transporting rollers with each groove having a width of the yarn contacting surface within a range of being approximately equal to or less than the circumferential interval between grooves, it being understood that this width may also be substantially less than said interval between the grooves as with the rounded, truncated cogs extending radially between adjacent grooves to form the yarn contacting surfaces shown in FIGS. 1 and 1*a*. The case of the groove width being about equal to said interval between grooves is best shown by the rollers of FIG. 2 and 2*a*, i.e., with a groove and cog which are approximately the same size. In all cases, the depth of the groove should not substantially exceed the width of the groove at the yarn contacting surface.

The present invention is especially applicable to the use of nip rollers which are normally mounted rotatably at adjustably positioned intervals between their axes of rotation, thereby exerting a clamping or gripping effect on the yarn running therebetween. A positive or non-slip gripping action serves to transport the yarn at the peripheral speed of the two rollers.

Figure 3:
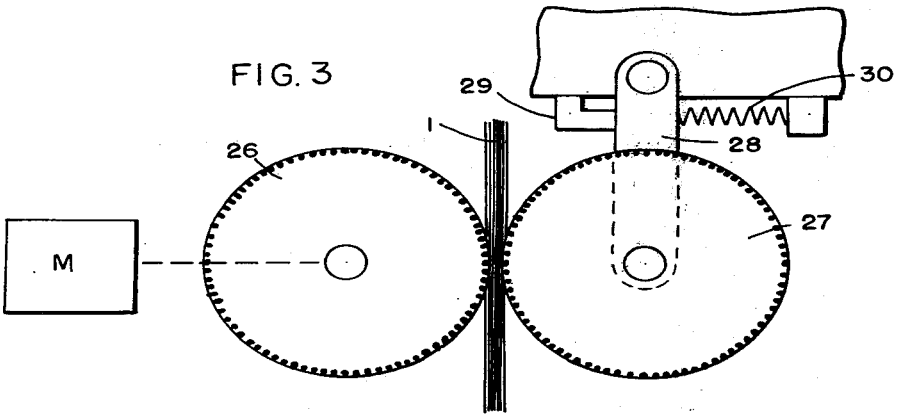
FIG. 3 is a partly schematic view of a pair of rollers of the type shown in FIGS. 2 and 2*a*, arranged as nip rollers in accordance with the invention.

As shown in FIG. 3, the nip rollers 26 and 27 are grooved or fluted as described above and arranged close together to receive the yarn 1 for transport therebetween. A motor M or other suitable drive means, preferably with a variable speed adjustment, is used to rotate the roller 26 which has a fixed axis of rotation and can be mounted on the frame or housing of the transporting apparatus in any conventional manner. The second roller 27 is rotatably mounted on the swinging arm 28. The movement of this arm 28 is restricted by the stop member 29 as the arm moves in the direction of the roller 26. Roller 27 is resiliently urged toward roller 26 by the spring means 30 while using the stop 29 to maintain a small gap space or nip opening between the rollers of at least about 0.1 mm. or more, depending upon the size of the yarn. The axial interval or distance between the roller axes of rollers 26 and 27 may thus be adjusted by resetting the stop 29 while spring 30, preferably with adjustable spring pressure in a conventional manner, ensures a firm but gentle gripping of the transported yarn 1. The rigidity of the mounting for roller 26 and 27 should also be considered. The more rigid the bearing support, the smaller the gap space may be between the two rollers. Thus, even relatively small sizes of yarns may be handled with this apparatus under appropriate conditions.

Figure 4:
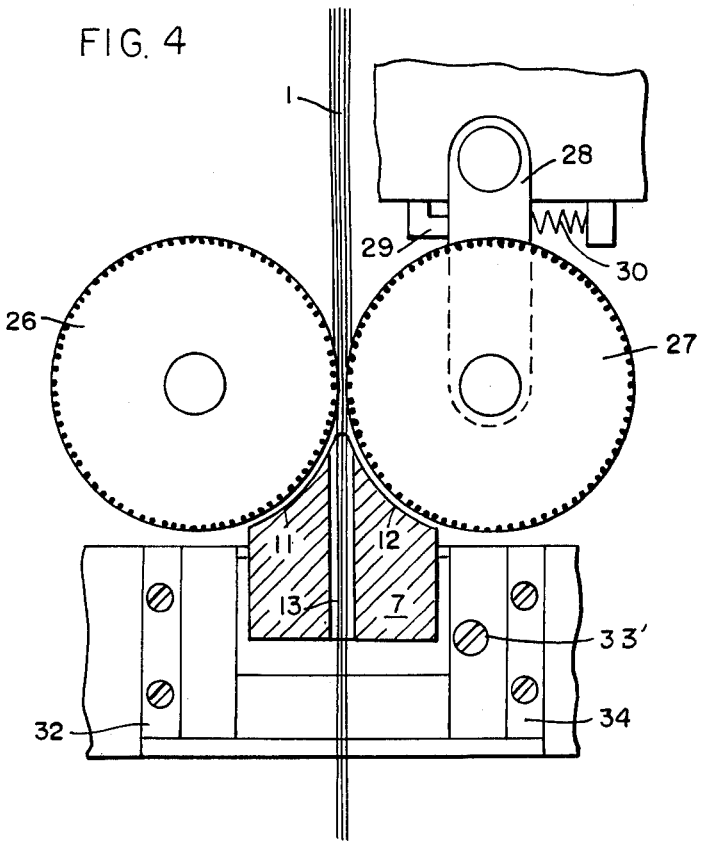
FIG. 4 is another partly schematic front elevational view of nip rollers as in FIG. 3 but with the addition of a yarn guide device shown in longitudinal section.

In a further preferred embodiment of the invention, a yarn guide member is provided immediately following the nip rollers 26 and 27 in the direction of yarn travel such that the air stream after the nip rollers is given a definite direction corresponding to the normal yarn path extending tangentially from the nip point of the rollers. One example of such a yarn guide device is shown in FIG. 4 wherein the yarn 1 passes through the nip opening of the transporting rollers 26 and 27 directly into the inlet mouth of a preferably elongated yarn guide channel 13 of the guide member 7 which is fitted into the flared bight or discharge angle of the nip rollers. The guide channel or bore 13 is aligned directly under the nip opening between the rollers and extends from front to back over the entire effective width of this nip opening as determined by the thickness of the nip rollers coming to contact with the yarn. Note FIG. 5 together with FIG. 4. The yarn guide body 7 also contains a narrow slot 16 extending over its entire length and providing access to the guide channel 13 for ease of insertion or threading of the yarn not only in the thread guide but also between the nip rollers 26 and 27. With these nip rollers being rotatably supported in cantilevered positions forwardly of their bearings, it is most convenient to insert the yarn from the free end of the rollers as shown. The rapid and simple insertion of the yarn 1 in the yarn guide slot 16 is of the utmost importance in handling continuously produced yarns, especially when they are running at high speeds.

The thread or yarn guide member 7 is movable on the guide or mounting bars 32 and 34, using screws or other fastening means to firmly hold the guide member 7 in a desired position. This movement of guide member 7 is thus restricted to the plane of the nip rollers 26 and 27, i.e., so that the guide channel 13 remains in the plane of the clamping gap or nip opening. The space between the upper, oppositely disposed, outer flanks 11 and 12 of the guide member 7 may also be carefully adjusted in this manner with respect to the facing cylindrical yarn contacting surfaces of the rollers. Thus, these guide member flanks 11 and 12 which diverge arcuately from the inlet mouth of the inner guide channel 13 provide wall members in close proximity to the oppositely facing yarn contacting surfaces of the rollers 26 and 27. Such construction tends to prevent air turbulence as the yarn is discharged or emerges from the nip opening in its normal yarn path, the air streams following the path of least resistance so as to preferentially flow through the guide channel 13.

Figure 5:
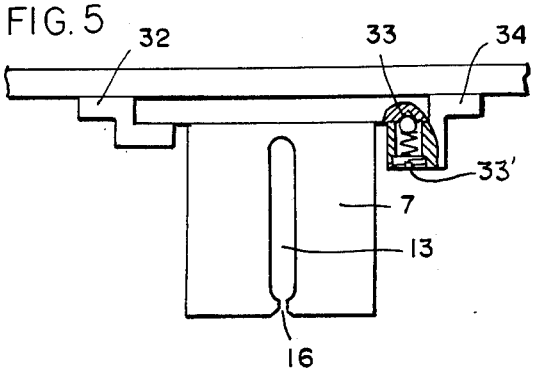
FIG. 5 is a partly schematic top view of the yarn guide device shown in FIG. 4.

The yarn guide member or block 7 is preferably locked in a predetermined position by means of a spring-actuated arresting device 33 with spring adjusting screw 33' as shown in FIGS. 4 and 5. The guide member is thereby locked in its operating position. If a yarn breakage and/or formation of a winder should take place, the guide member 7 can be quickly released and moved downwardly to remove the winder which usually forms on the driven roller 26. If the winder is formed by only one or a few broken filaments, it is thereby possible in most cases to remove the winder before the entire yarn bursts. Thus, yarn breakage is substantially avoided and rethreading of a rapidly moving yarn is facilitated.

The preferred embodiment of the invention using nip rolls in combination with the interfitted thread guide device has a definite advantage in safely transporting yarns of large sizes of up to and even more than 100,000 denier while operating at linear yarn speeds in excess of 1,000 m/min. and especially above 3,000 m/min. The yarn is generally delivered as a compact bundle or strand of parallel filaments by the yarn guide device while lappings or winders are also substantially reduced if not entirely avoided by using the grooved roller surfaces protected on the discharge side of the nip opening by the arcuate flanks or walls 11 and 12 of guide 13.

In order to also safely collect the transported yarn, the embodiment of nip rollers and guide member shown in FIG. 4 is especially suitable when arranged directly before an open collection receptacle such as a spinning can or storage bin where the yarn can be deposited. Such collection of the yarn for storage has not been illustrated since it does not represent a distinguishing feature of the yarn transporting apparatus. Likewise, the original source of the yarn is not shown although it will be understood that freshly spun thermoplastic filaments can be drawn down or stretched at very high linear speeds, using conventional apparatus which may be used to feed yarn directly to the yarn transporting apparatus disclosed and claimed herein.

When handling yarn at such very high linear or transporting speeds, for example where it can be brought into a parallel position with the thread guide member at a constant high speed, difficulties may still be encountered in attempting to bring the yarn into the guide member. Moreover, damage to the yarn becomes increasingly difficult to prevent as the yarn speed increases above about 3,000 meters per minute, for example up to 5,000 and even 6,000 m/min.

It is therefore a further object of the invention to provide an especially advantageous combination of nip rollers with a thread guide member which is constructed as a yarn conveying jet nozzle operating on the air injection principle by providing the inner guide channel with side openings or ports from air conduits on one or more cross-sectional planes to produce an air jet inclined in the direction of transport of the yarn. Such a jet nozzle or injector guide member has the advantage that a freshly spun yarn obtained by melt spinning and stretching or the like, even when running at the highest available speeds, can be threaded on the nip rollers and introduced into the conveying guide channel without disrupting the spinning and stretching operations. Moreover, once compressed air is supplied from a suitable source, e.g. using a manifold supply means located in the yarn guide member itself, it may be used for a number of surprisingly useful functions. While the air is primarily introduced under pressure to carry along the yarn in the guide channel, it may be further used to advantage by directing an air stream through discharge ports arranged to direct an airstream counter to the rotational direction of the yarn contacting surfaces of the rollers. In this embodiment of the invention, it is further convenient and even necessary under extreme conditions to direct another airstream from feed apertures into the lateral yarn insertion slot, preferably in a direction transverse to the yarn insertion direction, thereby producing an air turbulence within the slot and a certain counterpressure which prevents the yarn from leaving the guide channel.

This preferred use of a yarn conveying jet nozzle is explained in detail by FIGS. 6 – 10 wherein the nip rollers 2 and 3 are provided in modified form as the primary yarn transporting means, the roller 2 being positively driven by a suitable motor (not shown in these subsequent figures) and the roller 3 being carried by arm 5 pivoted on the supporting pin 4 and resiliently urged toward roller 2 by the spring means 6.

Figure 6:
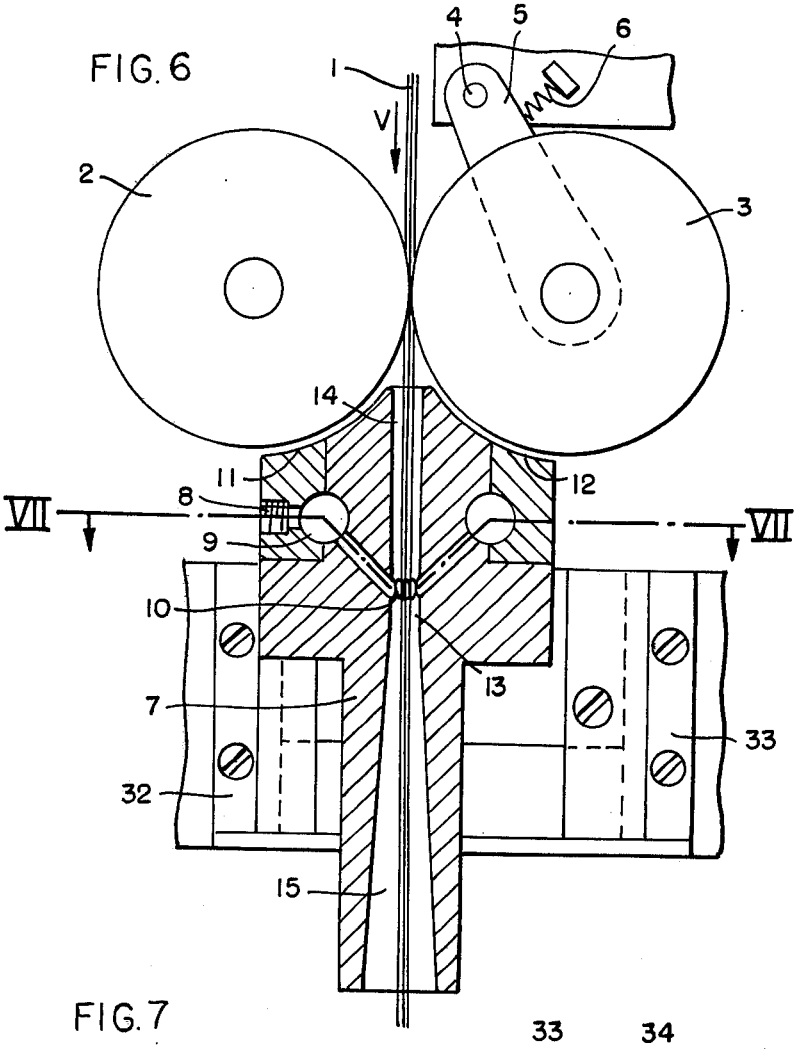
FIG. 6 is a partly schematic front elevational view of another embodiment of yarn transporting apparatus according to the invention incorporating a jet-operated yarn guide device shown in longitudinal cross-section together with a set of nip rollers.

As indicated in FIG. 6, the yarn 1 is intended to be transported from the spinning apparatus (not shown) at a constant velocity V in the direction of the arrow. This feed of the yarn cannot be interrupted due to the nature of the continuous melt spinning process. Therefore, the yarn guide member 7 in this case is modified to provide air injection from supply line 8 into the manifold 9 and through a plurality of air conduits 10 into the yarn guide channel 13 wherein a sufficient suction is created to first draw the yarn 1 into inlet mouth or bore 14 located in the flared bight or triangular-shaped zone directly below the nip point of the rollers and then completely through the constricted yarn channel 13 into the conically widening exit channel 15. With this jet nozzle or injector type of construction, it is possible to create a suction which will have a beneficial effect in collecting the yarn while also preventing yarn damage as the nip rollers provide the tension required to draw off the yarn or filamentary strands from the melt-spinning orifices or other feed, draw or conveying devices arranged between these spinning orifices and the nip rollers. Then, as the yarn emerges from the conically enlarged portion of the jet nozzle guide member 7, it runs comparatively free of tension such that it can be easily laid down or deposited in a spinning can or storage bin.

The yarnguide device 7 as a positive jet nozzle transporting means for the yarn is mounted in the same manner as described above with reference to FIGS. 4 and 5, i.e., so that it is locked in place by member 33 but can be quickly released and moved on guide bars 32 and 34 to a lower position while remaining in the plane of the nip rollers 2 and 3 for removal of filament winders.

One is not limited to the use of a single group or set of air conduits 10 discharging air in an inclined direction around the yarn since it is quite feasible to provide a second circular air supply manifold with another group of air conduits inclined in the direction of yarn travel but entering the channel 13 or even the exit zone 15 at a different axial position from the conduits 10.

The intake or entry end of the guide member 7 shown in FIG. 6 also provides the arcuately diverging flanks 11 and 12 which are fitted as closely as possible to the roller surfaces facing them so that guide member 7 occupies the discharge zone or so-called "bight" of the nip rollers as completely as possible. The flanks 11 and 12 should be fitted as closely as they can be maintained next to the rotating surfaces of the rollers 2 and 3 without touching these surfaces.

By means of this construction and arrangement of the jet guide 7 and the nip rolls 2 and 3, it is possible to guarantee a definite air stream pattern or flow characteristic in the still open wedge or triangulr-shaped area between the line of contact of rollers 2 and 3, on the one hand, and the upper end of the inlet bore 14, on the other hand.

The advantage of creating a strong flow pattern of the air stream in this wedge-shaped area or zone resides in the fact that a relatively heavy stream of air is directed radially inwardly against the yarn as soon as it enters the guide member 7. In addition, an air suction is created so that air is drawn through the gap extending between the rollers 2 and 3 and the flanks 11 and 12 of the guide member 7. This in turn prevents an air layer from being carried on the circumferential surfaces of the rollers, i.e., a layer which otherwise tends to cause the filaments or yarn to adhere thereto.

Due to the conical enlargement of the exit portion 15 of the yarn guide device 7, the air stream emerging from channel 13 is braked or substantially slowed down. However, this enlargement of the conical portion is limited so that air is not changed from laminar to turbulaent flow as it comes off the channel walls. The air must not be permitted to become turbulent because this causes the yarn to tangle or to burst.

The length of the conically enlarged exit portion 15 depends upon the technical or operational requirements in handling a particular yarn. In essence, this exit portion 15 has a very useful and advantageous effect caused by the fact that it permits the yarn to remain enclosed by an air column even after leaving the jet guide member, and the velocity of this air column is so high and the size of the column around the yarn is so great that the surrounding static air cannot affect the yarn dynamically. Also, because of the static pressure difference between the stationary air and the moving air column, a radial force becomes applied to the yarn to hold it together. The exiting yarn must retain a sufficiently high speed that it does not block off the exit channel 15.

Figure 7:
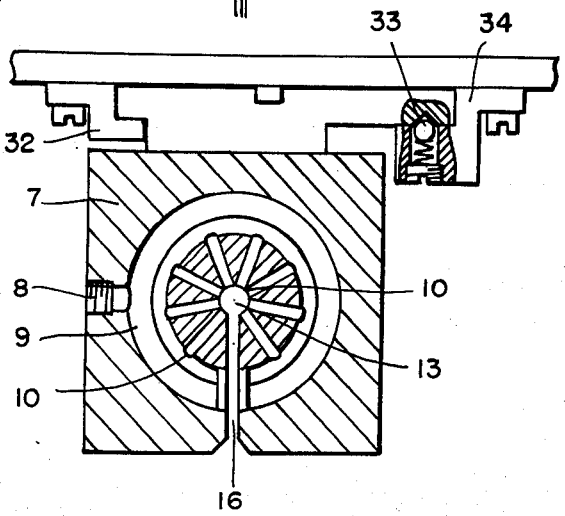
FIG. 7 is a cross-sectional view taken on line VII — VII of FIG. 6.

In the cross-sectional view of FIG. 7, taken on line VII — VII of FIG. 6, it will be noted that the yarn 1 can be inserted into the inner guide channel 13 by means of the slot 16. Again, this yarn insertion slot should extend over the entire length of the thread guide member 7, including all of the connected channels 13, 14 and 15. Although a stationary or slow moving yarn might be suctioned through the jet nozzle guide member 7, it is especially helpful to have slot 16 as the only practical means of inserting a very rapidly moving yarn.

The threading slot 16 should have a cross-section which is as narrow as possible, because while it must be large enough to receive conventional yarn sizes, it must also be small enough to restrict or even prevent air from escaping the guide channels such as channels 13. The undesired escape of air through the slot 16 can be a serious disadvantage because the air in its outward passage though the slot may tear out individual filaments or even the whole yarn from the guide channel. This problem especially occurs when the jet nozzle conveyor has a conically enlarged exit portion since a higher static pressure appears at this point with decreasing stream velocity. It would presumably be possible to close off the slot 16 with a flap or cover after the yarn has been inserted. However, this also proved to be impractical because individual filaments of the yarn tend to become caught in spaces between the slot and the flap or cover. The yarn guide can then become completely blocked so as to prevent further operation of the device until the yarn channels can be carefully cleaned and all filaments removed.

Figure 8:
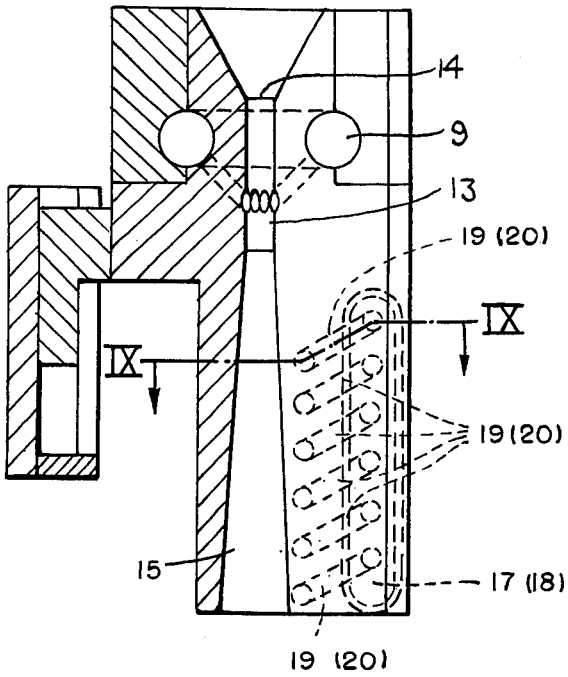
FIG. 8 is a longitudinal section of an especially preferred embodiment of a jet-operated yarn guide member.
Figure 9:
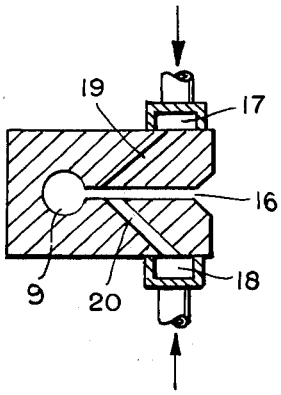
FIG. 9 is a cross-sectional view taken on line IX — IX of FIG. 8.

In order to overcome this problem, the present invention offers air screen means to block off the yarn insertion slot 16 in the manner indicated by modified embodiment illustrated in FIGS. 8 and 9. Thus, it is advantageous to provide air feed apertures on both of the inner faces of the insertion slot 16, for example by means of the obliquely inclined ducts or tap lines 19 and 20 which extend inwardly from the air feed boxes 17 and 18, respectively, which in turn may be in fluid connection with the circular manifold 9 or can be supplied with compressed air from any other suitable source. The distribution of a number of the lines 19 and 20 over the length of the slot 16 should be done in such a manner that the total flow of air from these lines will create a large air screen capable of preventing the yarn from escaping the channel 13 and especially 15 or even escaping completely through the slot 16 itself The lines 19 and 20 are preferably inclined in the direction of yarn travel as shown in FIG. 8 while also being inclined in the direction of yarn insertion as shown in FIG. 9. In addition to creating air turbulence in the yarn insertion slot 16, there is created an additional flow of air by the air streams from lines 19 and 20 in both the yarn insertion and yarn travel directions.

The proper distribution of lines 19 and 20 can also help to prevent the transported yarn from breaking open, especially in the conical exit portion 15 where there is a strong tendency for the expansion of the radial air stream already created in the previous channel portion 13. Thus, by slanting the feed of air toward the conveying or guide channel and also in the transporting direction, it is possible to create an air flow radial to the guide channel, especially channel 15, whereby not only is the transported yarn kept in the guide member over its entire length but also there is a better restraint on the tendency of the yarn to open out in any widened zone. The end result is the fact that the exit portion can be formed with a larger widening out of the conical enlargement with a corresponding desirable improvement in the braking effect.

It should be noted that very high speeds always cause some damage to individual filaments and this cannot be entirely avoided evven when precoating the yarn with finishing agents to reduce the number of filaments leaving the coherent yarn bundle. The success of the yarn transporting apparatus of the invention must therefore be attributed at least in part to the combination of a smooth laminar air stream within the guide channels and surrounding the yarn with a turbulent air screen produced in the yarn insert slot.

The air intake for the formation of the air screen can be reduced and the effect of this screen increased to an optimum if the number of air feed apertures in the lateral insertion slot is selected and a distribution of these apertures is made so as to match or balance the static pressure in the conveying guide channel. It will thus be apparent that the conically widening exit channel 15 requires the most protection with an air screen so that few if any tap lines 19 or 20 are required in the preceding conveying channels 13 and 14.

Figure 10:
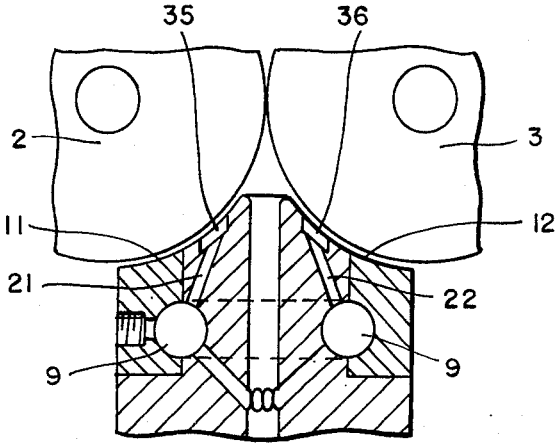
FIG. 10 is a front elevational view of a pair of nip rollers combined with yet another jet-operated yarn guide device shown in longitudinal section with added channels for blowing air onto the transporting roller surfaces.

Still another advantageous embodiment of the invention is shown in FIG. 10 where the air ducts 21 and 22 lead from the circular compressed air manifold 9 up to the air slots or vents 35 and 36 from which a stream of air is directed over the yarn transporting surfaces of each roller 2 and 3 in a direction counter to the rotation of these surfaces. This is an additional measure to prevent the rollers 2 and 3 from carrying an air stream or film on their circumferential surface and thereby entraining or carrying along individual filaments from the yarn. A single air vent 35 and 36 in each arcuate flank or wall 11 and 12 is generally sufficient to maintain a steady backflow of air toward the wedge-shaped or triangular-shaped zone at the discharge bight of the nip rollers, thereby containing the yarn and any stray filaments in this area where the suction effect of the jet nozzle also strongly influences the yarn to enter the inner guide and conveying channel 13.

With respect to the yarn conveying jet nozzle of FIGS. 8 and 9, it will now be appreciated that this air injection device is highly useful in itself for transporting yarns without being combined with nip rolls or other yarn transporting rollers. The rapid insertion of a yarn into the conveying channel by means of a lateral slot closed off only by an air screen offers a means of handling and transporting yarns under a wide variety of conditions, especially where the constant speed of commonly rotated rollers is not required but only a positive suction effect.

Yarn conveying jets or injection nozzles are generally known but ordinarily depend upon the suction effect itself for threading the nozzle through one end. For example, such nozzles have been used as independent means of conveying yarn or in combination with superimposed transporting rolls; compare the Czechoslovakian Patent Specification No. 367,371. The jet devices described in this instance are disadvantageous because the transport of yarns from spinning machines, now being carried out at linear yarn speeds of more than 3,000 m/min., cannot be interrupted. For this reason, the insertion of the yarn in the prescribed jets or nozzles causes great difficulties. Even where the prior art does disclose a lateral slot in a suction conveying device (British Patent Specification No. 1,142,786), the slot is made in such a manner that the yarn must be cut. By comparison, the novel yarn conveying jet device of the present invention does permit the insertion of a moving yarn without any interruption of the specific textile operation. This feature becomes extremely important and practically indispensable where one must insert a continuously running thread or yarn in the jet conveyor without cutting the yarn at some point. Accordingly, it is again emphasized that the jet conveying apparatus of the invention by itself and working only on the injection principle provides a very useful means of transporting yarn, especially a continuously directed yarn running at high speeds above 1,000 and preferably above 3,000 m/min.

The invention is hereby claimed as follows:

1. In a high speed yarn transporting apparatus having two transporting nip rolls mounted rotatably at adjustably positioned intervals between their axes of rotation to exert a clamping or gripping effect on the yarn running therebetween, the improvement which comprises:

yarn contacting circumferential surfaces on each of said rolls which contain a plurality of grooves distributed thereover;

means to drive each of said nip rolls at about the same speed of rotation with respect to each other when gripping said yarn therebetween;

means to resiliently urge one nip roll toward the other in yarn contacting relationship; and stop means to maintain a gap space between the yarn contacting circumferential surfaces of said nip rolls.

2. Apparatus as claimed in claim 1 wherein said grooves on each roller are formed parallel to the roller axis of rotation.

3. Apparatus as claimed in claim 1 wherein said stop means maintains a gap space of at least about 0.1 mm.

4. Apparatus as claimed in claim 1 wherein said grooves divide each of said cylindrical yarn contacting surfaces into cogs such that each of said nip rolls is in the form of a tooth gear.

5. Apparatus as claimed in claim 1 wherein the width of each said groove at a yarn contacting surface is within a range of being approximately equal to or less than down to being substantially smaller than the circumferential interval between grooves, and the depth of each said groove does not substantially exceed said groove width.

6. Apparatus as claimed in claim 1 wherein said grooves divide each of said cylindrical yarn contacting surface into rounded, truncated cogs extending radially between adjacent grooves to form the yarn contacting surface.

* * * * *

UNITED STATES PATENT AND TRADEMARK OFFICE

CERTIFICATE OF CORRECTION

PATENT NO. : 3,964,657

DATED : June 22, 1976

INVENTOR(S) : Erich Lenk, Karl Bauer, Herbert Turk

It is certified that error appears in the above-identified patent and that said Letters Patent are hereby corrected as shown below:

First page, line 12, left-hand column, insert --July 4, 1973, German Application 2333992--.

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*